United States Patent [19]

Mühle

[11] Patent Number: 4,640,072

[45] Date of Patent: Feb. 3, 1987

[54] MULTIPART THERMALLY INSULATED METAL PROFILE FOR FACADE STRUCTURES OR ROOF STRUCTURES

[76] Inventor: Manfred Mühle, Tulpenstr. 11, DE-4972 Löhne 2, Fed. Rep. of Germany

[21] Appl. No.: 793,697

[22] PCT Filed: Feb. 6, 1985

[86] PCT No.: PCT/DE85/00031

§ 371 Date: Oct. 15, 1985

§ 102(e) Date: Oct. 15, 1985

[87] PCT Pub. No.: WO85/03733

PCT Pub. Date: Aug. 29, 1985

[30] Foreign Application Priority Data

Feb. 24, 1984 [DE] Fed. Rep. of Germany ..... 3406722

[51] Int. Cl.[4] ..... E04B 1/62

[52] U.S. Cl. ..... 52/403; 52/398; 52/464; 49/DIG. 1

[58] Field of Search ..... 52/403, 468, 469, 395, 52/398, 459, 461, 464; 49/DIG. 1

[56] References Cited

U.S. PATENT DOCUMENTS 4,395,862 8/1983 Jager et al. ..... 52/403 X
4,418,506 12/1983 Weber et al. ..... 52/398 X

FOREIGN PATENT DOCUMENTS 2527842 1/1977 Fed. Rep. of Germany ..... 52/403
2608325 9/1977 Fed. Rep. of Germany ..... 52/398

*Primary Examiner*—Carl D. Friedman
*Assistant Examiner*—Naoko N. Slack
*Attorney, Agent, or Firm*—Max Fogiel

[57] ABSTRACT

A multipart thermally insulated metal profile for facade structures or roof structures, which receives covering panels made of glass (9) or other materials (10) between an interior profile (2) and an exterior profile (1) with interposition of sealing means (7, 8), while the exterior profile (1) is screwed to insulators (4) let into the interior profile (2), is to be provided with a more favorable heat transfer coefficient, designating the k value, than was hitherto possible. For this purpose the interior profile (2) is composed of a contact profile (11) for covering panels (9, 10) and a screening profile (12) oriented parallel thereto at an interval on the room side, which are mutually connected by means of insulating bars (13) anchored in respective profile grooves and continuous in the longitudinal direction of the profiles. Furthermore, the profile members (14) facing the covering panels (9, 10), extending beyond the width of the contact profile (11) and forming lateral water discharge channels (15) may be arranged additionally on the screening profile (12), particularly for the horizontal or inclined installation of the profiles.

6 Claims, 2 Drawing Figures

Figure 1:
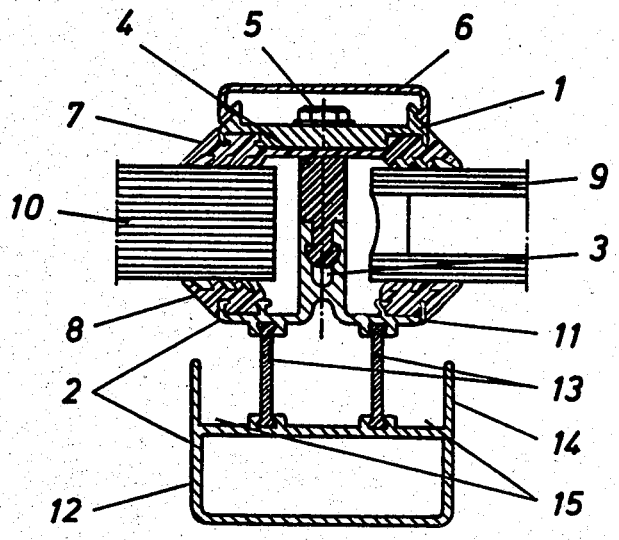

MULTIPART THERMALLY INSULATED METAL PROFILE FOR FACADE STRUCTURES OR ROOF STRUCTURES

The invention relates to a multipart thermally insulated metal profile for facade structures or roof structures which receives covering panels made of glass or other materials between an interior profile and an exterior profile with interposition of sealing means, while the exterior profile is screwed to insulators let into the interior profile.

Such metal profiles, which are known from German Auslegeschrift No. 2,023,536 and German Offenlegungsschrift No. 3,202,482, have the disadvantage that the insulators extending between the exterior profile and the interior profile have a depth which is a function of the thickness of the covering panels. As a result of this, only a limited insulation coefficient of the metal profiles is obtained, which cannot be further improved by means of the conventional structural features.

The aim of the invention is to provide multipart metal profiles intended for facade structures or roof structures of the type in question with a more favorable heat transfer coefficient, called the k value, than was hitherto possible. It is also proposed to provide these profiles with a discharge for condensation moisture, which is of considerable importance when they are installed horizontally or inclined.

In order to achieve the aim adopted, the invention proposes that the interior profile is composed of a compact profile for the converting panels and a screening panel oriented parallel thereto at an interval on the room side, which are mutually connected by means of insulating bars continuous in the longitudinal direction of the profiles and anchored in respective profile grooves. An advantageous further development of this structural form is obtained if profile members forming lateral water discharge channels facing the covering panels and extending beyond the width of the contact profile are arranged on the screening profile combined with the contact profile to form the interior profile. Better strength characteristics of this profile arrangement can furthermore be achieved in that the screening profile is constructed as a hollow profile. Another measure serving the same purpose may consist in that plastics strips or plastics brackets are fitted into the screening profile, which connect it nonpositively to an additional reinforcing profile.

By virtue of the features of the invention, it has been possible to make available a profile structure which is substantially superior in its k value to all the composite profiles hitherto used in facade construction. A satisfactory discharge of the condensation moisture which may possibly form is provided simultaneously.

Figure 2:
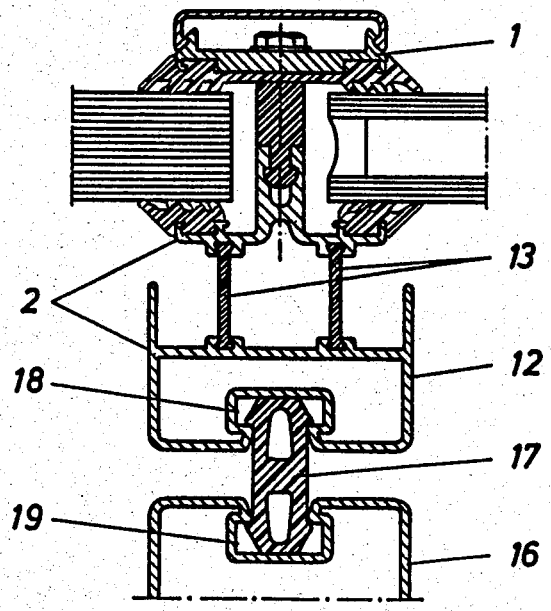

Exemplary constructions of the object of the invention are described with reference to the drawing, wherein in detail:

FIG. 1 shows the sectional view of a multipart thermally insulated metal profile for facade structures and roof structures constructed according to the invention and FIG. 2 shows the sectional view of a similar profile arrangement complimented by a reinforcing profile.

The multipart metal profiles illustrated both in FIG. 1 and in FIG. 2 consist of an exterior profile 1 and an interior profile 2, the connection of which occurs by insulators 4 let into a longitudinal groove 3 of the interior profile 2 by means of screws 5 penetrating the exterior profile 1. By this means covering panels made of glass 9 or other material 10 of a facade structure or roof structure are retained between the exterior profile 1 which carries a masking cap 6 and the interior profile 2 with interposition of sealing means 7 and 8.

According to the features of the invention the interior profile 2 is composed of a contact profile 11 and a screening profile 12 constructed as a hollow profile and oriented parallel thereto at an interval on the room side, which are mutually connected by means of insulating bars 13 continuous in the longitudinal direction of the profiles and anchored in respective profile grooves. As a result of this measure, an additional insulating zone unlimited in its dimensions is created and an extremely favorable k value is obtained for the profile arrangement selected.

Where composite profiles of the type illustrated are to be installed in a horizontal or inclined position, it is advantageous if profile members 14 facing the covering panels 9 and 10, which extend beyond the width of the contact profile 11 and thereby form lateral water discharge channels 15, are arranged on the screening profile 12 which is combined with the contact profile 11 to form the interior profile 2.

In order to improve the strength characteristics of the described profile structure, the reinforcing profile 16 illustrated in FIG. 2 may be adopted. Its connection to the screening profile 12 occurs by plastics strips or plastics brackets 17, which are clipped into a longitudinal groove 18 formed by the screening profile 12 on the one hand and into a similar longitudinal groove 19 of the reinforcing profile 16 on the other hand.

I claim:

1. A multipart thermally insulated metal profile for facade structures or roof structures, comprising: an exterior profile member and an interior profile member; insulator means connecting said inner profile member and said exterior profile member; covering panels comprised of glass or other materials held between said exterior profile member and said interior profile member with interposition of sealing means; screw means penetrating said exterior profile member and fastening said insulator means to said exterior profile member, said insulator means extending into said interior profile member; said interior profile member comprising further a contact profile member for said covering panels and a screening profile member oriented parallel thereto at an interval on a room side; insulating bars connecting continuously said contact profile member and said screening profile member in longitudinal direction of said profile members, said insulating bars being anchored in respective grooves in said profile members.

2. A multipart thermally insulated metal profile as defined in claim 1, including profile elements facing said covering panels and extending beyond the width of said compact profile member, said profile elements forming lateral water discharge channels arranged on said screening profile member, said screening profile member being combined with said contact profile member to form said interior profile member.

3. A multipart thermally insulated metal profile as defined in claim 1, wherein said screening profile member comprises a hollow profile member.

4. A multipart thermally insulated metal profile as defined in claim 1, including plastic strips fitted into said screening profile member; and a reinforcing profile member connected to said screening profile member by said plastic strips.

5. A multipart thermally insulated metal profile for facade structures or roof structures, comprising: an exterior profile member and an interior profile member; insulator means connecting said inner profile member and said exterior profile member; covering panels comprised of glass or other materials held between said exterior profile member and said interior profile member with interposition of sealing means; screw means penetrating said exterior profile member and fastening said insulator means to said exterior profile member, said insulator means extending into said interior profile member; said interior profile member comprising further a contact profile member for said covering panels and a screening profile member oriented parallel thereto at an interval on a room side; insulating bars connecting continuously said contact profile member and said screening profile member in longitudinal direction of said profile members, said insulating bars being anchored in respective grooves in said profile members; profile elements facing said covering panels and extending beyond the width of said contact profile member, said profile elements forming lateral water discharge channels arranged on said screening profile member, said screening profile member being combined with said contact profile member to form said interior profile member; said screening profile member comprising a hollow profile member; plastic strips fitted into said screening profile member; a reinforcing profile member connected to said screening profile member by said plastic strips.

6. A multipart thermally insulated metal profile as defined in claim 1, including pastic brackets fitted into said screening profile member; and a reinforcing profile member connected to said screening profile member by said plastic brackets.

* * * * *